United States Patent [19]

Cejka

[11] 3,977,005

[45] Aug. 24, 1976

[54] ANTENNA BASE ASSEMBLY

[75] Inventor: Joseph B. Cejka, Fair Haven, N.J.

[73] Assignee: Ward Products Corporation, New Brunswick, N.J.

[22] Filed: Jan. 2, 1975

[21] Appl. No.: 538,015

[52] U.S. Cl. ..... 343/715; 52/110

[51] Int. Cl.[2] ..... H01Q 1/32; H01Q 1/20

[58] Field of Search ..... 343/702, 715, 882, 900; 52/110; 403/90, 128, 130, 132, 143

[56] References Cited

UNITED STATES PATENTS

| | | | |
|---|---|---|---|
| 2,671,186 | 3/1954 | Shoobert | 403/128 |
| 3,409,317 | 11/1968 | Richards | 403/128 |
| 3,483,888 | 12/1969 | Wurzel | 403/128 |
| 3,704,645 | 12/1972 | Grauso et al. | 403/90 |

FOREIGN PATENTS OR APPLICATIONS

| | | | |
|---|---|---|---|
| 1,008,492 | 10/1965 | United Kingdom | 343/715 |

*Primary Examiner*—Ernest R. Purser
*Assistant Examiner*—William Randolph

[57] ABSTRACT

A universal type of vehicle antenna base assembly for mounting an antenna mast on a vehicle body panel in a variety of angular positions. The antenna base assembly comprises a base plate having a ball seat aperture therethrough and means for rigidly affixing the base plate to a vehicle body panel, and an elongated generally cylindrical mast holder which includes a generally spherical enlarged portion between its upper and lower ends sized to be pivotably seated in the base plate ball seat. A retaining means is provided for locking the mast holder in a fixed position with respect to the base plate. Optionally, a decorative cover cap is provided to cover at least the retaining means of the base assembly.

5 Claims, 7 Drawing Figures

ANTENNA BASE ASSEMBLY

BACKGROUND OF THE INVENTION

This invention relates to vehicle radio antennas, and, more particularly, to a universal type of antenna base assembly for mounting an antenna mast on a vehicle body panel in a variety of angular positions.

A wide variety of antenna base assemblies are in current use for mounting vehicle radio antenna masts to the body panels of vehicles. For example, when installed as original equipment by vehicle manufacturers, antenna base assemblies are generally designed for a specific fender contour of a particular vehicle model which, when rigidly mounted at a predetermined location on the vehicle, results in the antenna mast having the desired angular attitude. Thus, as body styling changes are made, the antenna base assembly design must also be changed to accommodate the new fender contours.

In the retail installation and replacement markets, the universal type of antenna base assembly has predominated in recent years wherein a single base assembly permits angular adjustment of the antenna mast so as to be useable with a variety of differing fender contours. Heretofore, these universal base assemblies have generally utilized a rocker anchor bracket positioned under the fender and an adjustable nut and bezel type of assembly on top of the fender which are tightened together when the antenna mast is at the desired angular attitude to sandwich the fender panel in between and thereby lock the assembly in the desired position. However, these universal base assemblies suffer from several disadvantages. First, fender vibrations during vehicle use have a tendency to loosen these mountings resulting in loose and misaligned antenna masts. In addition, while these universal base assemblies are somewhat similar in appearance to the base assemblies installed as original equipment by the major vehicle manufacturers in years past, antenna base design changes in recent years which have tended toward thinner and more streamlined base plates have rendered the appearance of these bulky universals outdated. Thus, a consumer wishing to install or replace a vehicle antenna on a recent model vehicle has been forced to either purchase an exact duplicate of the original equipment design, which is often expensive and difficult to locate, or to purchase one of the existing universals with the above design and mounting disadvantages. Moreover, the absence heretofore of a sturdy universal approximating the design of modern original equipment antenna designs has forced vehicle dealers to maintain inventories of almost all past antenna models for the various vehicle models in recent years for purposes of exact warranty replacement or for satisfying the customer who wishes exact antenna replacement on a vehicle out of warranty.

Thus, there has been a definite need for a new universal antenna base assembly which is sturdy, not subject to loosening by fender vibrations, and which can have a design appearance similar to the thin, streamlined base assemblies in use today as original equipment.

SUMMARY OF THE INVENTION

According to the present invention, there is provided a universal type of antenna base assembly for mounting an antenna mast on a vehicle body panel in a variety of angular positions which provides a sturdy mounting and which can be constructed to provide the external appearance of a wide variety of antenna base designs which have been used in the past or which will be used in the future without changing the functional features thereof. Thus, the universal base assembly of the present invention, in a small number of external design variations, can be used for almost duplicate replacement or installation of the vast myriad of antenna base designs utilized as original equipment by vehicle manufacturers over the years.

The novel antenna base assembly comprises a base plate having means for rigidly affixing the base plate to the exterior side of a vehicle body panel, preferably two or more holes for receiving sheet metal screws to screw the base plate firmly to the vehicle body panel. The base plate, which can have any desired configuration depending upon whatever external design appearance is being sought, has an aperture therethrough from the top surface through the bottom surface thereof with the diameter of the aperture at the bottom surface being less than the diameter at the top surface to form a ball seat. Preferably, the aperture has a stepped-down diameter which results in a retaining lip around the periphery of the aperture near the bottom surface of the base plate to provide the requisite ball seat.

The base assembly further comprises an elongated generally cylindrical mast holder with means at its top end for attaching the lower end of an antenna mast, e.g., a threaded or tapered socket to receive the threaded or force-fit fitting on the lower end of the antenna mast, respectively, and means at its lower end for attaching a radio cable, e.g., a male or female fitting to mate with a complementary fitting on the end of the radio cable. Between its upper and lower ends, the mast holder has a generally spherical enlarged portion having a diameter less than the diameter of the base plate aperture at the top surface of the base plate and greater than the diameter of the base plate aperture at the bottom surface of the base plate so that the mast holder is insertable in the base plate aperture with the enlarged portion being pivotably seated in the ball seat of the base plate aperture. Thus, the mast holder can be pivoted until the desired angular attitude of the mast is achieved. A retaining means is provided for locking the mast holder in a fixed position with respect to the base plate when the desired angular attitude of the mast has been achieved. Preferably, the retaining means comprises a thin retaining plate having an aperture with a diameter greater than the upper end of the mast holder and less than the enlarged portion of the mast holder so that it can be positioned over the top end of the mast holder to abut the enlarged portion thereof. The retaining plate has means for rigidly affixing it to the base plate, e.g., two or more holes for screws which are screwed therethrough into corresponding threaded holes in the base plate, so that as the retaining plate is rigidly affixed to the base plate, it frictionally engages the enlarged portion of the mast holder to lock it in the desired angular position.

Finally, a decorative cover cap is preferably provided which fits over the upper end of the mast holder to cover the retaining means and in some cases the entire base plate to provide an aesthetically pleasing finished appearance. The cover cap can be held in place by, for example, side detents which snap into corresponding grooves in the side of the base plate.

DESCRIPTION OF THE PREFERRED EMBODIMENTS

Figure 1:
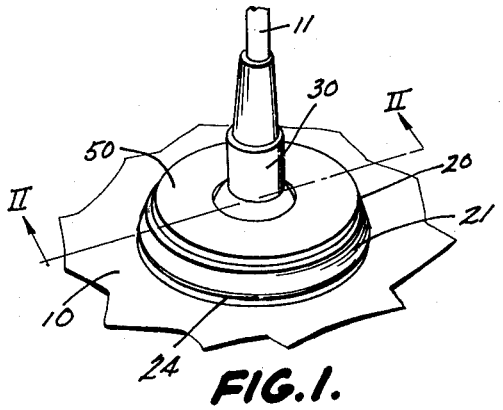
FIG. 1 is a perspective view of one embodiment of the antenna base assembly of the present invention mounted on a vehicle fender and holding an antenna mast.

Referring now to the drawings in more detail, FIG. 1 is a perspective view of one embodiment of the novel antenna base assembly 20 mounted on a vehicle fender panel 10 and holding an antenna mast 11.

Figure 4:
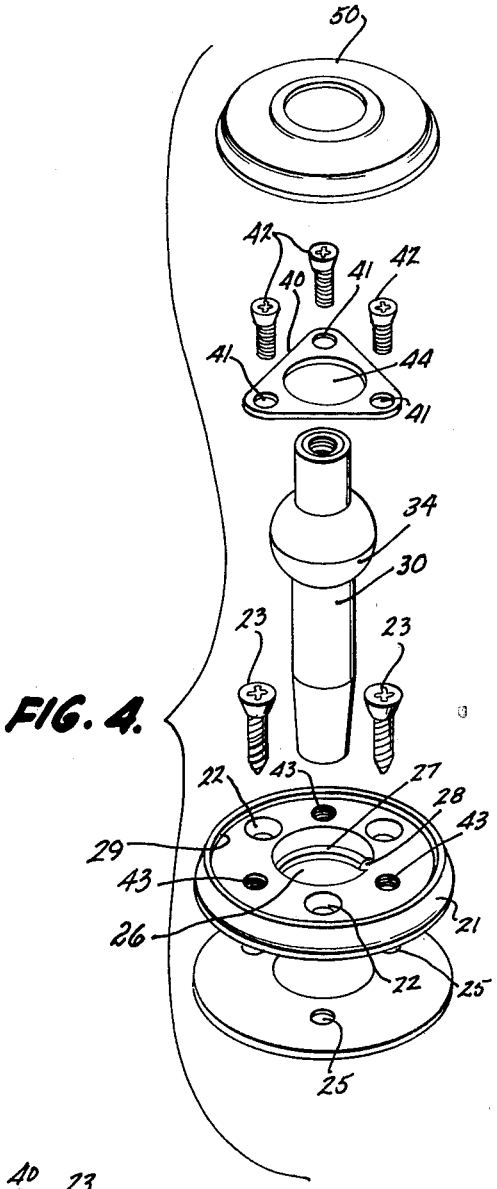
FIG. 4 is an exploded perspective view of the base assembly of FIG. 1.

As is most clearly shown in FIG. 4, base assembly 20 includes a base plate 21 having three screw holes 22 for receipt of sheet metal screws 23 for rigidly mounting base plate 21 to fender panel 10. Preferably, a resilient pad 24 made of rubber, plastic, or the like is interposed between base plate 21 and fender panel 10 to act as a shock absorber and to ensure a firm mounting of base plate 21 on fender panel 10 without denting and scratching of the surface of fender panel 10. Pad 24 has screw holes 25 corresponding with screw holes 22 in base plate 21.

Base plate 21 also has a generally central aperture 26 therethrough for receipt of mast holder 30 as will be discussed more fully hereinafter.

Figure 2:
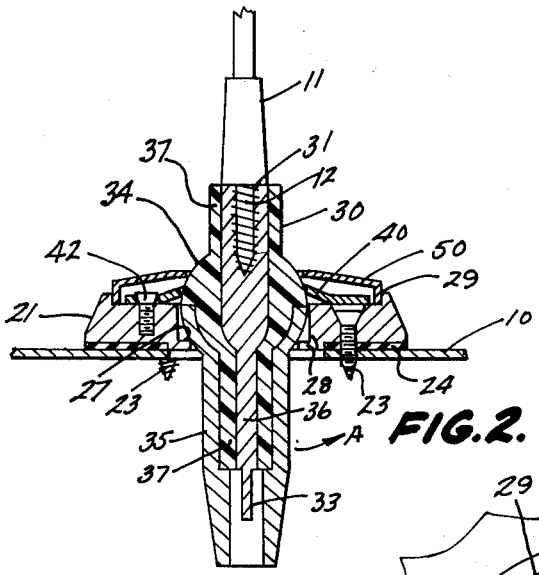
FIG. 2 is a side cross-sectional view of the base assembly of FIG. 1 taken along the line II—II of FIG. 1.
Figure 3:
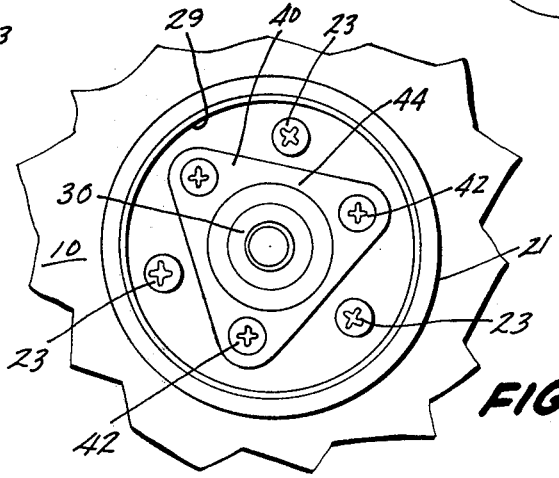
FIG. 3 is a plan view of the base assembly of FIG. 1 with the mast and cover cap removed.

As is best seen in FIGS. 2 and 3, mast holder 30 is an elongated, generally cylindrical member with a threaded socket 31 at its top end for threadably receiving the threaded lower end 12 of antenna mast 11. At the lower end of mast holder 30 is a socket 32 with an axially disposed pin plug 33 for receiving and mating with a female connector end plug on one end of a radio cable (not shown) which connects the antenna to the vehicle radio.

Between the upper and lower ends of mast holder 30 is an enlarged generally spherical portion 34 which provides the pivot point for adjustment of mast holder 30 to vary the angular attitude of antenna mast 11. Thus, mast holder 30 is positioned in aperture 26 of base plate 21 with the lower end extending below base plate 21 and with enlarged portion 34 being pivotably seated in aperture 26. In order to provide a pivot ball seat for enlarged portion 34, aperture 26 has a diameter at the top surface of base plate 21 greater than the diameter of enlarged portion 34 and a diameter at the bottom surface of base plate 21 less than the diameter of enlarged portion 34 but large enough to permit the lower end of mast holder 30 to pass there-through. Preferably, a stepped-down diameter is employed in aperture 26 so that a peripheral retaining lip 27 is formed to provide the requisite ball seat for enlarged portion 34, Thus, when mast holder 30 is seated in base plate 21 as shown in FIG. 2, it can be universally pivoted in any direction to alter the angular attitude of antenna mast 11. Since the degree of pivot of mast holder 30 in any direction is limited only by the contact of mast holder 30 just below enlarged portion 34 with the inside edge of retaining lip 27, a greater degree of pivot can be achieved if desired by providing one or more cut-outs in retaining lip 27, such as cut-out 28, so that in the direction of a cut-out (arrow A in FIG. 2), the lower end of mast holder 30 can move further before contact is made with retaining lip 27.

Although the internal structure of mast holder 30 is a matter of choice depending upon the economics of available manufacturing methods, mast holder 30 as shown comprises a lower outer conductive metal shell 35, a conductive metal insert 36 with the threaded mast socket 31 at one end and the pin plug 33 at the other, and a plastic insulator 37 surrounding the length of insert 36, except for pin plug 33, and separating insert 36 from shell 35. Further, the plastic insulator is shaped to form the top of the enlarged generally spherical portion 34 of mast holder 30. As will be obvious to those skilled in the art, this structure provides a conductive path between the antennna mast and the center conductor wire of the radio cable which is insulated from a ground path between the vehicle fender, base plate 21, metal shell 35, and the ground wire or braid of the radio cable.

A retaining means 40 is provided for locking mast holder in the proper pivot position with respect to base plate 21 so that antenna mast 11 is fixed with the desired angular attitude. In the embodiment of FIGS. 1–4, the retaining means 40 preferably comprises a generally triangular thin plate with three peripheral holes 41 for receipt of screws 42 to rigidly attach retaining plate 40 to base plate 21 by screwing screws 42 through holes 41 into corresponding threaded holes 43 in base plate 21. Retaining plate 40 has a central aperture 44 which is sized to fit over the upper end of mast holder 30 and to frictionally engage the upper surface of the enlarged spherical portion 34 of mast holder 30. Thus, as screws 42 are tightened, the frictional engagement between retaining plate 40 and the upper surface of spherical portion 34 will increase until mast holder 30 is locked in the particular pivot position. As noted above, the upper surface of spherical portion 34 is plastic, e.g., polypropylene, which is preferred as it provides for superior frictional engagement with retaining plate 40 to yield a secure locking engagement. Since the locking means is independent of the means for mounting the base assembly on the vehicle body panel (screws 23), the tendency of vehicle vibrations to loosing the mast holder are minimal. The locking action of retaining plate 40 is most clearly seen in FIGS. 2 and 3.

Finally, a decorative cover cap 50 is provided which fits around the top of mast holder 30 and frictionally engages the inside surface of a raised lip 29 on base plate 21 with a snap fit to cover retaining plate 40 and mounting screws 23 to yield an aesthetically pleasing finished appearance to the base assembly as shown in FIG. 1.

Figure 5:
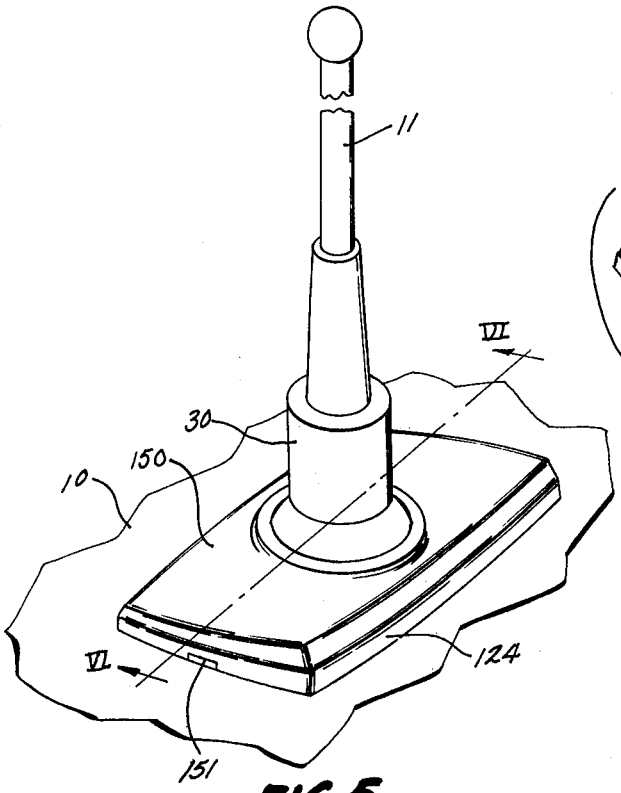
FIG. 5 is a perspective view of a second embodiment of the antenna base assembly of the present invention mounted on a vehicle fender and holding an antenna mast.
Figure 7:
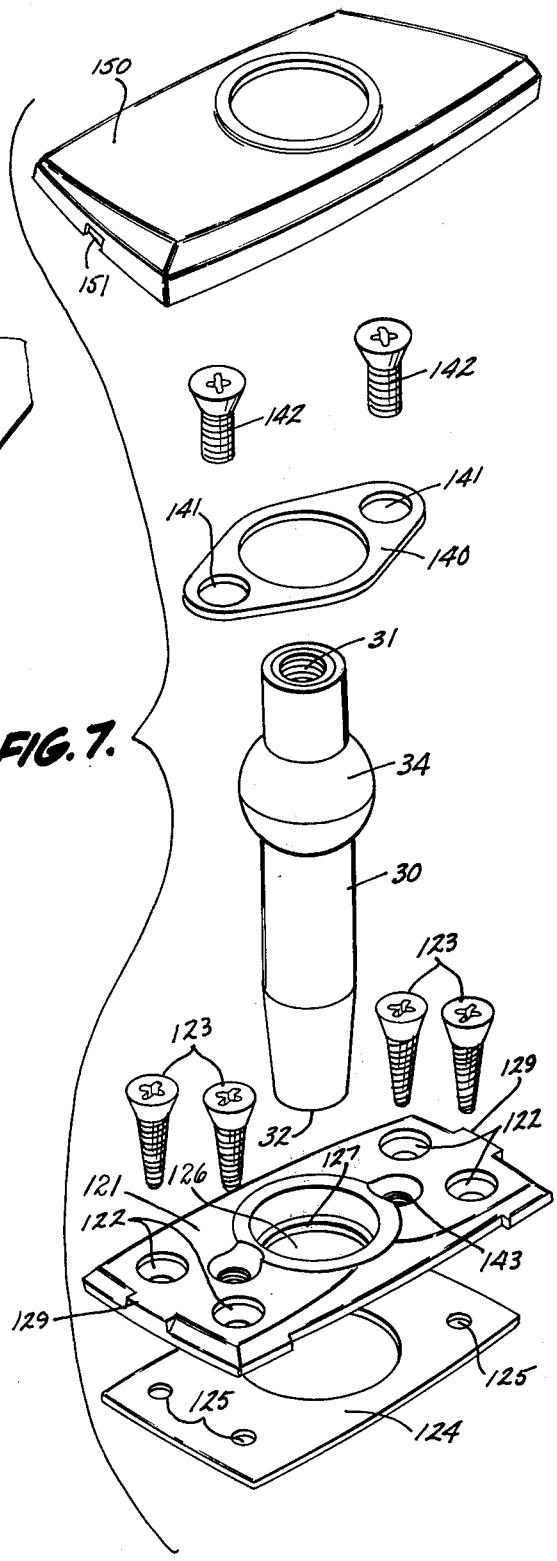
FIG. 7 is an exploded perspective view of the base assembly of FIG. 5.
Figure 6:
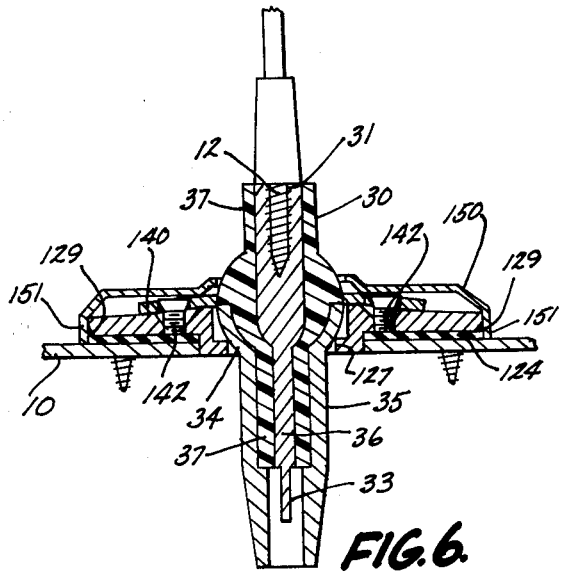
FIG. 6 is a side cross-sectional view of the base assembly of FIG. 1 taken along the line VI—VI of FIG. 5.

In FIGS. 5–7, a second embodiment of the base assembly of the present invention is illustrated wherein like numerals denote like parts. The embodiment of FIGS. 5–7 illustrates the external design appearance variation which is achievable with the novel base assembly without substantially changing the basic functional parts thereof. Basically, the embodiment of FIGS. 5–7 differs from the embodiment of FIGS. 1–4 in that a generally rectangular base configuration is employed as opposed to the circular configuration of FIGS. 1–4. Thus, using the identical mast holder 30, a rectangular base plate 121 is employed with a corresponding rectangular cover cap 150 and pad 124. The aperture 126 and retaining lip 127 are the same as aperture 26 and lip 27 above to accommodate mast holder 30 in the manner explained above. Four mounting sheet metal screws 123 are used to mount base plate 121 to fender panel 10 through screw holes 122 in base plate 121 and holes 125 in pad 124. Because of the rectangular configuration of base plate 121, a generally elliptical retaining plate 140 is employed to lock mast holder 30 in position by means of a pair of screws 142 through holes 141 in plate 140 into corresponding threaded holes 143 in base plate 121.

To lock cover cap 150 in place over base plate 121, a pair of opposed detents 151 are provided in cap 150 which snaps over a pair of corresponding end tongues 129 on the ends of base plate 121.

While the preferred embodiments of the antenna base assembly of the present invention have been described and illustrated, it will be obvious to those skilled in the art that various changes and modifications can be made without departing from the scope of the invention. For example, while a circular and a rectangular base configuration have been described, any number of various geometric configurations can be employed. Also, while retaining plates are preferred for locking the mast holder in the desired position, the retaining plates could be replaced by one or more screws threadably received in the base plate adjacent the spherical portion of the mast holder so that as the screws are tightened, the screw heads frictionally engage the spherical portion of the mast holder to lock it in position. In addition, the cover caps shown could themselves function as the retaining means. For example, cover cap 50 could have peripheral external threads so as to be threadably received in corresponding internal threads on raised lip 29 on base plate 21 and as cover cap were screwed onto base plate 21, its central aperture would frictionally engage the top surface of spherical portion 34 of mast holder 30 in the same manner as was discussed above with respect to retaining plate 40. Finally, while a single rod mast 11 threadably received in mast holder 30 has been described, the mast could as well be a multiple section telescoping mast and it could have a force fit means of attachment into mast holder 30. Therefore, the scope of the present invention is deemed to be limited only by the appended claims.

The embodiments of the invention in which an exclusive property or privilege is claimed are defined as follows:

1. An antenna base assembly for mounting an antenna mast on a vehicle body panel comprising: a base plate with a top surface and a bottom surface, said base plate having means for rigidly affixing said base plate to the exterior side of said vehicle body panel, and having an aperture therethrough from said top surface through said bottom surface, the diameter of said aperture at said bottom surface being less than the diameter of said aperture at said top surface to form a ball seat; an enlongated generally cylindrical mast holder, said holder having means at its top end for attaching the lower end of said antenna mast, means at its lower end for attaching a radio cable, and a generally spherical enlarged portion between its top end and its bottom end having a diameter less than the diameter of said aperture at the top surface of said base plate and greater than the diameter of said aperture at the bottom surface of said base plate, the upper surface of said enlarged portion of said mast holder being a plastic material and said mast holder being received through said base plate aperture so that said enlarged portion is pivotably seated in said base plate aperture ball seat and said top end of said holder extends above the top surface of said base plate; and retaining means for locking said holder in a fixed position with respect to said base plate, said retaining means comprising a thin retaining plate with a generally central aperture sized so that said retaining plate fits over the top end of said mast holder and abuts said upper surface of said enlarged portion of said mast holder and means independent of said base plate affixing means for rigidly attaching said retaining plate to said base plate whereby said retaining plate frictionally engages said enlarged portion of said mast holder as said retaining plate is rigidly attached to said base plate to lock said holder in a fixed position with respect to said base plate.

2. The antenna base assembly of claim 1 wherein said base plate has a generally circular configuration, said retaining plate has a generally triangular configuration and said means for rigidly attaching said retaining plate to said base plate comprises a plurality of screw means.

3. The antenna base assembly of claim 1 wherein said base plate has a generally rectangular configuration, said retaining plate has a generally elliptical configuration and said means for rigidly attaching said retaining plate to said base plate comprises a plurality of screw means.

4. The antenna base assembly of claim 1 which further comprises a decorative cover cap covering at least said retaining plate.

5. The antenna base assembly of claim 1 wherein said base plate aperture has a stepped down diameter which forms a lower internal peripheral lip in said aperture whereby said internal lip functions as said ball seat.

* * * * *